US010626677B2

(12) United States Patent
Finnman

(10) Patent No.: US 10,626,677 B2
(45) Date of Patent: Apr. 21, 2020

(54) BY-PASS FLUID PASSAGEWAY FOR DRILL TOOL

(71) Applicant: SANDVIK INTELLECTUAL PROPERTY AB, Sandviken (SE)

(72) Inventor: Karl-Oskar Finnman, Sandviken (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 66 days.

(21) Appl. No.: 15/506,836

(22) PCT Filed: Aug. 24, 2015

(86) PCT No.: PCT/EP2015/069317
§ 371 (c)(1),
(2) Date: Feb. 27, 2017

(87) PCT Pub. No.: WO2016/030311
PCT Pub. Date: Mar. 3, 2016

(65) Prior Publication Data

US 2017/0254152 A1 Sep. 7, 2017

(30) Foreign Application Priority Data

Aug. 28, 2014 (EP) ..... 14182606

(51) Int. Cl.

| | |
|---|---|
| ***E21B 10/23*** | (2006.01) |
| ***E21B 10/18*** | (2006.01) |
| ***E21B 10/25*** | (2006.01) |
| ***E21B 10/24*** | (2006.01) |
| ***E21B 10/16*** | (2006.01) |

(52) U.S. Cl.
CPC ..... *E21B 10/23* (2013.01); *E21B 10/16* (2013.01); *E21B 10/18* (2013.01); *E21B 10/24* (2013.01); *E21B 10/25* (2013.01)

(58) Field of Classification Search
CPC ..... E21B 10/23; E21B 10/25; E21B 10/24; E21B 10/16; E21B 10/18
See application file for complete search history.

(56) References Cited

U.S. PATENT DOCUMENTS

| | | | |
|---|---|---|---|
| 2,260,487 | A | 10/1941 | Scott |
| 2,318,370 | A | 5/1943 | Burch |
| 3,102,601 | A | 9/1963 | Worth |
| 3,193,028 | A | 7/1965 | Ivan |

(Continued)

FOREIGN PATENT DOCUMENTS

| | | |
|---|---|---|
| CL | 30784 | 12/1975 |
| CL | 38514 | 12/1990 |

(Continued)

*Primary Examiner* — David J Bagnell
*Assistant Examiner* — Jonathan Malikasim
(74) *Attorney, Agent, or Firm* — Corinne R. Gorski

(57) ABSTRACT

A rotary drill tool for cutting rock includes a set of journal legs that rotatably mount rotating cone shaped cutters via respective bearing assemblies. A fluid supply passageway extends through the journal legs to provide a cooling and cleaning fluid to the bearings during use. A by-pass passageway extends through a base region of the spindle that mounts each cone cutter and is provided in direct fluid communication with the supply passageway to divert the fluid to a base region of the bearing assembly.

11 Claims, 15 Drawing Sheets

(56) References Cited

U.S. PATENT DOCUMENTS

| | | | | | |
|---|---|---|---|---|---|
| 3,303,898 | A * | 2/1967 | Bercaru | E21B 10/24 175/228 |
| 3,921,735 | A | 11/1975 | Dysart | |
| 4,193,463 | A | 3/1980 | Evans | |
| 4,249,622 | A | 2/1981 | Dysart | |
| 4,390,072 | A | 6/1983 | Phelan | |
| 4,421,184 | A | 12/1983 | Mullins | |
| 4,427,307 | A * | 1/1984 | Norlander | E21B 10/22 331/158 |
| 4,511,008 | A | 4/1985 | Brunson | |
| 4,516,640 | A * | 5/1985 | Karlsson | E21B 10/23 175/337 |
| 4,688,651 | A | 8/1987 | Dysart | |
| 4,942,930 | A * | 7/1990 | Millsapps, Jr. | E21B 10/24 141/114 |
| 5,183,123 | A | 2/1993 | White | |
| 6,408,957 | B1 | 6/2002 | Sandvik | |
| 6,626,251 | B1 * | 9/2003 | Sullivan | E21B 10/08 175/40 |
| 7,552,783 | B2 * | 6/2009 | Viswanadham | E21B 10/22 175/371 |
| 10,024,107 | B2 * | 7/2018 | Peterson | E21B 10/23 |
| 2001/0050187 | A1 | 12/2001 | Slaughter et al. | |
| 2012/0160561 | A1 | 6/2012 | Ramirez et al. | |

FOREIGN PATENT DOCUMENTS

| | | |
|---|---|---|
| CL | 4642017 | 2/2017 |
| CN | 201679448 U | 12/2010 |
| SU | 1357532 A1 | 12/1987 |

* cited by examiner

BY-PASS FLUID PASSAGEWAY FOR DRILL TOOL

RELATED APPLICATION DATA

This application is a § 371 National Stage Application of PCT International Application No. PCT/EP2015/069317 filed Aug. 24, 2015 claiming priority of EP Application No. 14182606.5, filed Aug. 28, 2014.

FIELD OF INVENTION

The present invention relates to a rotary drill tool and in particular, although not exclusively, to a drill tool configured to provide an additional fluid flow path for a cooling and cleaning fluid at a base region of a bearing assembly that rotatably mounts a cutter at a spindle part of the tool.

BACKGROUND ART

Rotary drills have emerged as an effective tool for specific drilling operations such as the creation of blast holes and geothermal wells. The drill typically comprises a rotary drill bit having three journal legs that mount respective cone-shaped rolling cutters via bearing assemblies that includes rollers and balls.

Typically, the drill bit is attached to one end of a drill string that is driven into the borehole via a rig. The cutting action is achieved by generating axial feed and rotational drive forces that are transmitted to the drill bit via the drill rods coupled end-to-end. Each of the cone-shaped cutters comprise externally mounted hardened cutting buttons positioned at different axial regions for optimised cutting as the drill bit rotates.

So as to cool the bearings, air is typically supplied down the drill string through the journal legs and into an internal cavity of each cutter within which the bearings are mounted. The air circulates around the bearings and is vented via the cavity mouth. Example rotating bits and cutters are described in U.S. Pat. Nos. 3,193,028; 3,921,735; 4,688,651, 4,421,184, 4,193,463; U.S. 2012/0160561; U.S. Pat. Nos. 4,390,072; 4,511,008 and SU 1357532.

In particular, the air flow to the different regions of the bearing assemblies is achieved via air flow passageways formed within a spindle (commonly referred to as a journal) that mounts each cutter and the respective bearings. Typically, the air circulates around the bearings and flows in a directional path of least resistance. Accordingly, differential cooling problems arise in existing cutting tools with certain bearing regions being inadequately cooled. As will be appreciated, insufficient air flow over the bearings leads to temperature rise due to friction and results in enhanced wear and a corresponding shortening of the operational lifetime of the bearings, the cutter and the spindle.

To prevent dust and dirt ingress into the bearing assemblies, it is known to divert a portion of the fluid (typically air) to the base region of the spindle to force and expel any debris material radially outward away from the cutter's cavity mouth positioned at the junction between the journal leg and the spindle. Example fluid directing passageways are described in U.S. Pat. Nos. 5,183,123 and 6,408,957. However, despite the supply of fluid to regions of the bearing assembly via separate distribution passageways within the spindle, existing assemblies are not optimised to provide a controlled supply of fluid being distributed effectively over all regions of the load and friction bearing surfaces whilst maintaining an exhaust flow at the cavity mouth (and possibly other regions of the cutter) to prevent debris ingress and contamination of the bearings. Accordingly, what is required is a drill tool that address the above problems.

SUMMARY OF THE INVENTION

It is an objective of the present invention to provide a rotary drill tool configured for optimised cooling of the bearing assemblies that mount each cone cutter whilst minimising the risk of dirt ingress into the region of the bearing assemblies. It is a further specific objective to provide an open or semi-sealed rotary drill bit having an optimised internal fluid flow passageway network to deliver the cooling fluid to high friction regions of the bearing assemblies without permitting dust and debris laden air surrounding the cutting tool to penetrate into the internal region of the cutter that mounts the bearings.

The objectives are achieved via a series of internal fluid flow passageways that include i) a fluid supply passageway that extends through each journal leg being provided in communication with ii) respective fluid distribution passageways within each spindle (journal) in addition to iii) at least one specific fluid by-pass passageway that extends from the fluid supply passageway to a base region of each bearing assembly. Each by-pass passageway is effective to divert a predetermined volume of the fluid (typically air) from the supply passageway directly to the base region of the bearing assembly prior to the fluid reaching the distribution passageways within each respective spindle. Accordingly, a desired volume of air is routed specifically to the base region of the spindle and bearing assembly located immediately inboard of the mouth of the internal cavity of the cutter. This configuration is advantageous to ensure the bearings located at the base of the spindle are adequately cooled whilst providing an exhaust fluid supply to direct radially outward any dust or debris that may collect or try to ingress into the internal volume of the cutter housing the bearings. Advantageously, the present by-pass passageway increases the volume of air supplied to the bearings which may otherwise be limited due to the dimensions of the ball plug hole and the ball plug.

The subject invention is suitable for 'open' cutter arrangements in which air is exhausted at the region between the cutter and the journal leg. In addition, the present arrangement is suited for 'semi-sealed' cone cutter arrangements in which an annular seal is provided at the base (or neck) region of the spindle that represents the interface between the spindle and the journal leg. Such latter arrangements may typically comprise vent holes provided through the body of the cutter so that the cooling/cleaning fluid is configured to exit primarily the tool through the main body of the cutter. The present by-pass passageway is beneficial to ensure a desired volume of cooling fluid is supplied to the bearings that are located at the base of the spindle that may otherwise sit outside of the fluid flow path where the fluid is distributed through the spindle via the distribution passageways and exits the tool via the vent holes within the cutter. The present by-pass passageway configuration is also beneficial to enhance the positive fluid pressure within the internal cavity of the cutter so as to prevent dust and debris penetrating into the cavity through the vent holes. Additionally, a positive pressure (via the by-pass passageway) is provided at the internal region of the cutter immediately inboard of the annular seal at the spindle base. That is, should any dust or debris ingress into the cone cavity (for example where the annular seal fails completely or partially)

the debris is prevented from travelling axially further into the inner region of the cavity.

According to a first aspect of the present invention there is provided a rotary drill tool for cutting rock comprising: a main body having a leg; a spindle projecting from the leg to mount a rotary cutter via a plurality of bearings; a fluid supply passageway extending through the leg and having a terminal end positioned in communication with a fluid directing passageway extending through the spindle, at least a part of the fluid directing passageway configured to allow at least some of the bearings to be loaded into position between the spindle and the cutter; characterised in that: the bearings comprise: a first set of roller bearings mounted at or towards the base region of the spindle and a set of ball bearings positioned at a bearing raceway axially between the first set of roller bearings and an end of the spindle; wherein a second end of the directing passageway emerges at the raceway and the second end of the by-pass passageway emerges at the first set of roller bearings.

Optionally, the by-pass passageway extends transverse or substantially perpendicular to the supply passageway. Optionally, the by-pass passageway may be aligned substantially parallel with a longitudinal axis of the spindle. The relative alignment of the supply and by-pass passageways is configured to divert a desired volume of the cleaning/cooling fluid (typically air) to the bearing assembly base region. Optionally, the supply and/or by-pass passageway may comprise a baffle or ducting to change the volume of air that is routed into the by-pass passageway.

Preferably, the bearings further comprise: a second set of roller bearings mounted at or towards an end of the spindle; and the set of ball bearings are mounted axially between the first and second set of roller bearings. Exiting the by-pass passageway at the base set of roller bearings is advantageous to ensure these rearward thrust bearings are cooled and cleaned sufficiently and independently of the main fluid flow supply to the bearing assembly from the directing passageway.

Preferably, the spindle comprises: a base raceway to mount the first set of roller bearings; and an end raceway to mount the second set of roller bearings; wherein the by-pass passageway emerges at the base raceway. Such a configuration is beneficial to ensure that the base raceway is cleaned and cooled directly by the flow of fluid from the by-pass passageway. In particular, and preferably, the base raceway is defined, in part, by a bearing support surface aligned substantially perpendicular or transverse to a longitudinal axis of the spindle and the by-pass passageway emerges at the bearing support surface. Such a configuration is effective to provide an optimised support surface in contact with the base roller bearings. Preferably, an end surface of each of the first set of roller bearings is positioned in contact with the bearing support surface, the by-pass passageway emerging adjacent to the end surfaces of each of the roller bearings. The specific positioning of the by-pass passageway at the end surface of the roller bearings provides a direct supply of the cleaning/cooling fluid to maximise the cleaning and cooling effect at this high friction region.

Optionally, the tool may further comprise an annular seal positioned between the base region of the spindle and the cutter to restrict fluid exiting the tool at the base region, the seal defining a semi-sealed internal region of the cutter in which the bearings are located. According to the specific implementation, the second end of the by-pass passageway emerges at the internal region. Accordingly, the by-pass passageway supplies the fluid to the internal components of the cavity at the inboard side of the seal. By directing the flow fluid from the by-pass passageway onto the base set of roller bearings the airflow path is optimised to completely envelop the bearings before exiting the cavity region via the seal and/or optional vent holes provided through the cutter.

Preferably, the spindle comprises an annular shoulder and an end, the shoulder positioned axially between the base region and the end; and the tool further comprises at least one distribution passageway extending within the spindle and provided in communication with the directing passageway; wherein the distribution passageway is divided into at least two passageways, a first passageway exiting the spindle substantially at the shoulder and a second passageway exiting the spindle substantially at the end. Such a configuration is advantageous to ensure all regions of the bearing assembly are cooled and cleaned by the fluid to create and maintain an optimised fluid flow path around the bearing assembly and specifically to ensure high temperature and high friction regions and surfaces are cooled and cleaned by the flowing fluid.

Preferably, a cross-sectional area of the by-pass passageway is substantially equal to or less than a cross-sectional area of each of the first and second distribution passageways. The relative dimensions of the different passageways ensures a positive pressure is established and maintained within the cavity to prevent dust and debris ingress.

Optionally, the tool comprises a single by-pass passageway extending in communication between the section of the supply passageway and the bearings. Optionally, the tool may comprise a plurality of by-pass passageways extending from at least one section of the supply passageway upstream of the terminal end. Preferably, the tool comprises two, three or four by-pass passageways extending from the same axial section of the supply passageway. The exit ends of the by-pass passageways are accordingly spaced apart in a circumferential direction at the bearing support surface. The bearing support surface may comprise one or a plurality of grooves or channels to further direct the fluid flow as it exits the by-pass passageways. Such an arrangement is also adaptable for use with a single by-pass passageway.

Optionally, the tool comprises at least two by-pass passageways and in particular, a first by-pass passageway exiting at a radially inner region of the bearing support surface and at least a second by-pass passageway exiting at a radially outer region of the bearing support surface. Optionally, the second by-pass passageway is divided into three passageways all exiting at the radially outer region of the bearing support surface and being spaced apart circumferentially around the bearing support surface. Optionally, two of the three second by-pass passageway are aligned parallel to one another and positioned side-by-side to extend generally from the same region of the supply passageway.

Where the cutter is a semi-sealed arrangement, the cutter comprises at least one vent hole to allow a fluid received from the directing passageway to exit the tool through the cutter. Optionally, the cutter comprises three sets of vent holes, a first set positioned at or towards a base of the cutter, a third set positioned at or towards an apex of the cutter and a second set positioned axially between the first and third sets of vent holes; wherein the by-pass passageway emerges from the spindle at a position axially closer to the base region of the cutter relative to a position at which the first set of vent holes extend through the cutter. The vent holes are beneficial to control and direct the fluid flow within the cavity to deliver the fluid to the high load and high friction regions to optimise cooling and cleaning. The vent holes are also advantageous to expel dust and debris at the external region of the cutter to maintain optimised cutting by the cutting buttons being free of dislodged rock, dust etc. As will be appreciated, the fluid flow within the cavity will naturally follow the least distance and the path of least resistance and by specifically positioning the vent holes at different axial and circumferential regions of the cutter, the cutter cleaning fluid circulation within the cavity is optimised.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
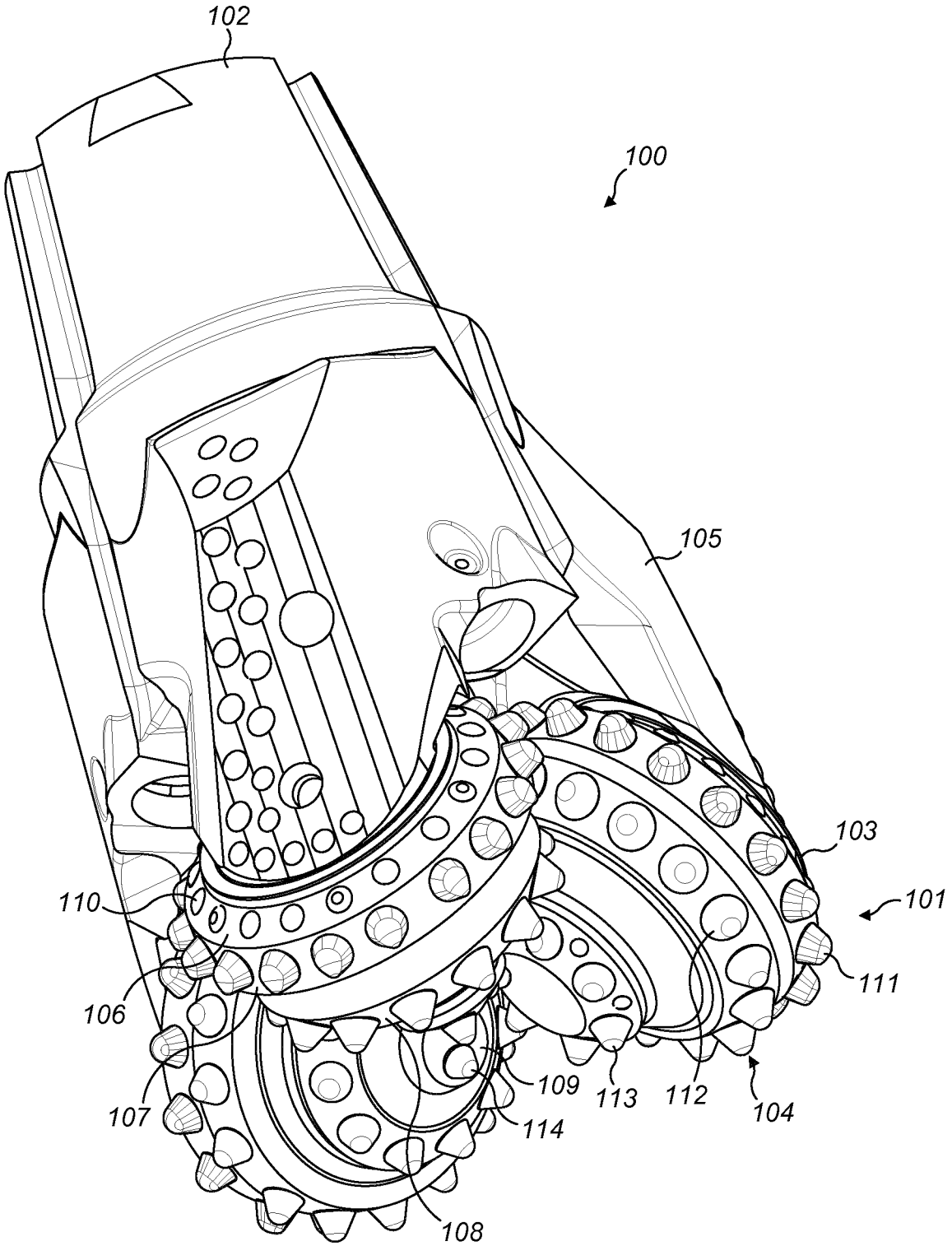
FIG. 1 is an external perspective view of a rotary cutting tool for mounting at one end of a drill string according to a specific implementation of the present invention.
Figure 2:
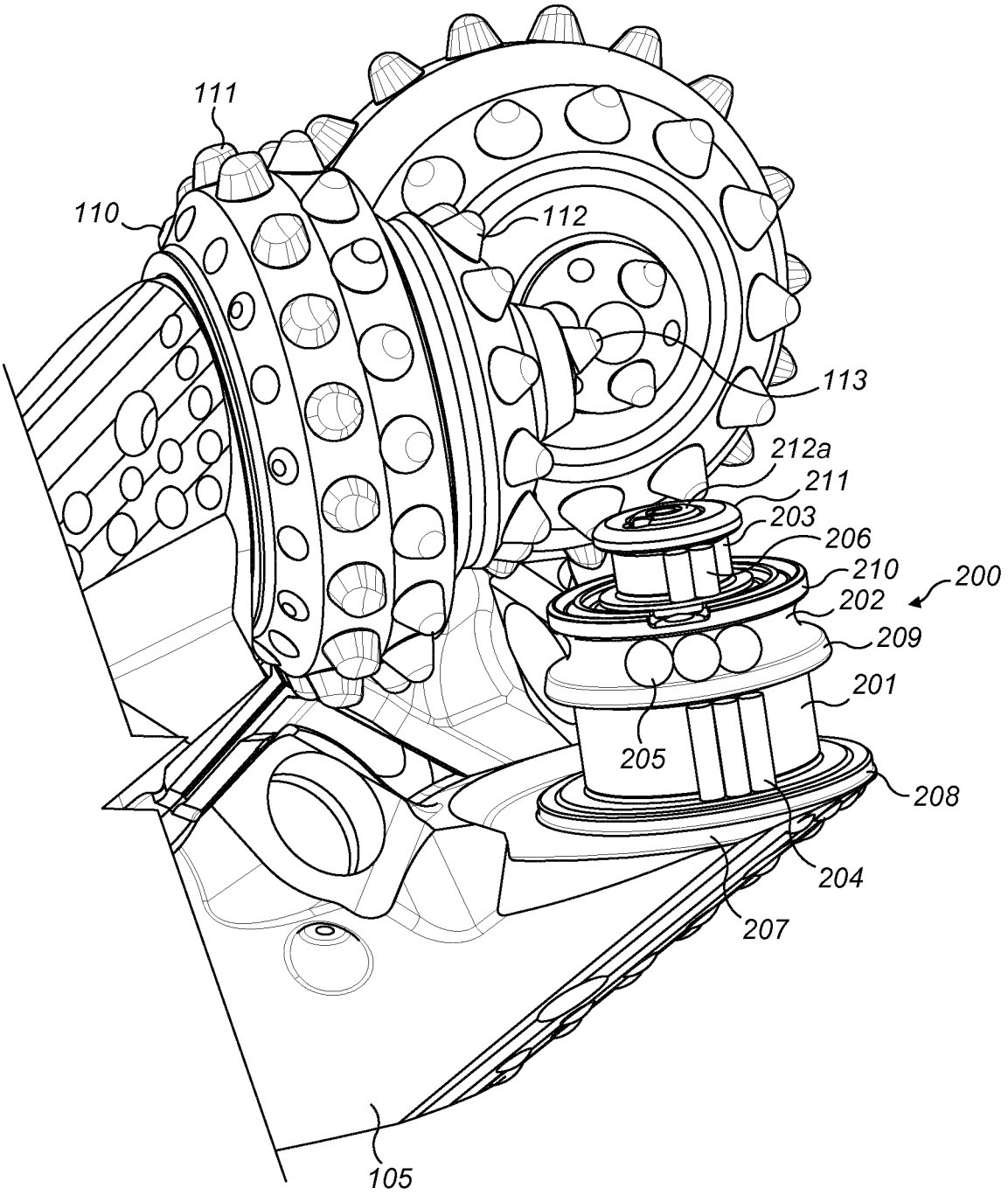
FIG. 2 is a further perspective view of the cutting end of the tool of FIG. 1 with one of the rotary cone cutters removed for illustrative purposes detailing a spindle that extends from one end of the journal leg.

Referring to FIG. 1, a rotary cutting tool 100 is formed as a cutting bit and comprises a cutting end 101 at an axially forward position and an axially rearward attachment end 102 configured for mounting at one end of a drill string (not shown) forming part of a drill assembly operated via a drilling rig (not shown) configured to provide axial and rotational drive of tool 100. Tool 100 comprises three journal legs 105 projecting axially forward from attachment end 102 and being aligned slightly radially outward such that cutting end 101 comprises a generally larger cross section than attachment end 102. A generally conical shaped cutter 103 is mounted at an end of each journal leg 105 so as to be capable of rotation relative to leg 105 and independent rotation about a separate axis relative to a general rotation of tool 100 and the drill string (not shown).

Referring to FIGS. 1 to 3B, a spindle 200 projects generally transverse from an axially forwardmost end 207 of each journal leg 105 and comprises a central longitudinal axis 307. Spindle 200 may be considered to be divided into three axial sections. A generally cylindrical base section or annular base raceway 201 is defined axially between an annular base flange 208 mounted at journal leg end 207 and a first intermediate radially projecting flange 209. An intermediate annular section or bearing raceway 202 extends axially beyond base raceway 201 and is defined axially between first intermediate flange 209 and an intermediate second radially projecting flange 210 that represent a shoulder region of spindle 200. Raceway 202 comprises a generally concave external surface. A third generally cylindrical annular section or bearing raceway 203 projects axially from intermediate section 202 and is defined between second annular flange 210 and an annular end flange 211. An apex region of the spindle 200 is defined by an annular thrust or end surface 308 provided at section 203. Additionally, a recess 300 extends axially within section 203 from thrust surface 308 and mounts a short cylindrical thrust plug 212*a*. Section 203 represents a nose or pilot region of spindle 200. A first set of base roller bearings 204 are mounted at base raceway 201 and extend axially between flanges 208 and 209. A second or end set of roller bearings 206 extend axially between flanges 210, 211 being mounted at end raceway 203. Additionally, a set of ball bearings 205 are positioned axially intermediate roller bearings 204, 206 and are mounted at intermediate raceway 202.

Each cone cutter 103 comprises a generally cone or dome shaped configuration. In particular, and referring to FIG. 6 and FIG. 1, each cutter 103 comprises a radially external facing surface 617 and a radially internal facing surface 616 that defines an internal cavity indicated generally by reference 600. Referring to FIG. 1, in an axial direction cone cutter 103 may be divided into axial sections at outer surface 617 and comprises a heel row 106, a gauge row 107, a drive row 108 and an inner or apex region 109. A plurality of sets of cutting buttons indicated generally by reference 104 are provided at each respective axial section including in particular heel buttons 110, gauge buttons 111, drive buttons 112 and inner buttons 113, 114. Each cutting button 104 is formed from a wear resistant cemented carbide based material and may comprise any known configuration including semi-spherical, conical, ballistic, semi-ballistic or chisel shaped.

Figure 3A:
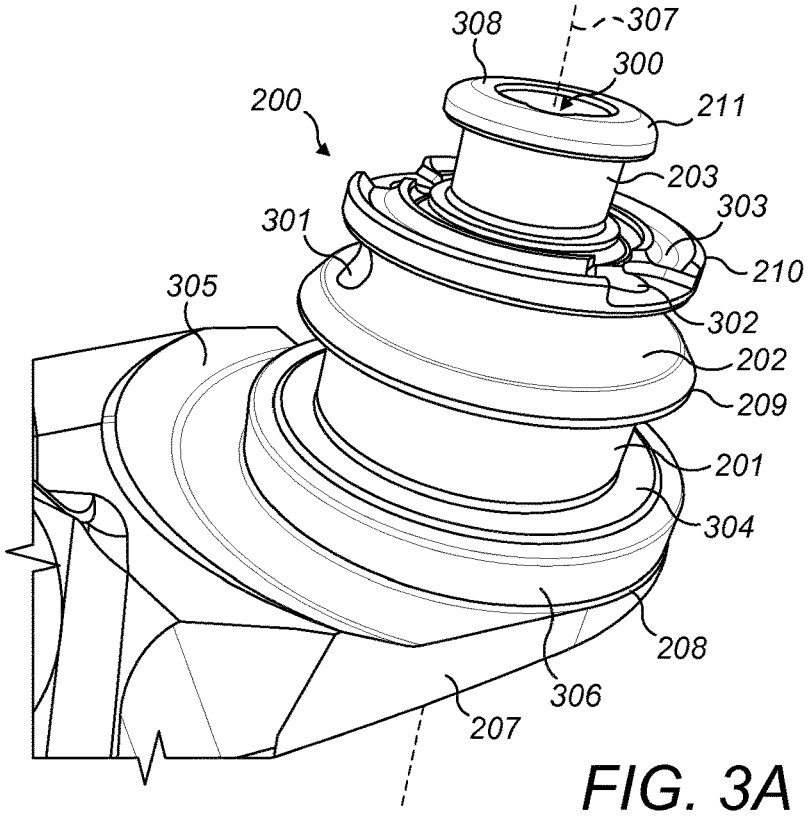
FIGS. 3A and 3B are further external perspective views of the spindle and journal leg of FIG. 2.
Figure 3B:
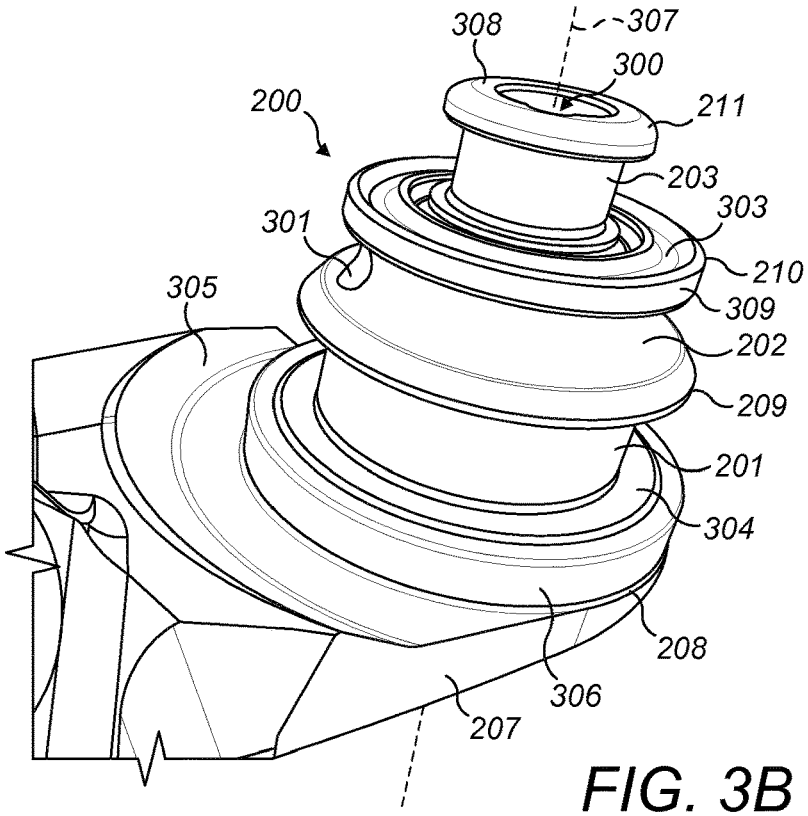
Figure 4:
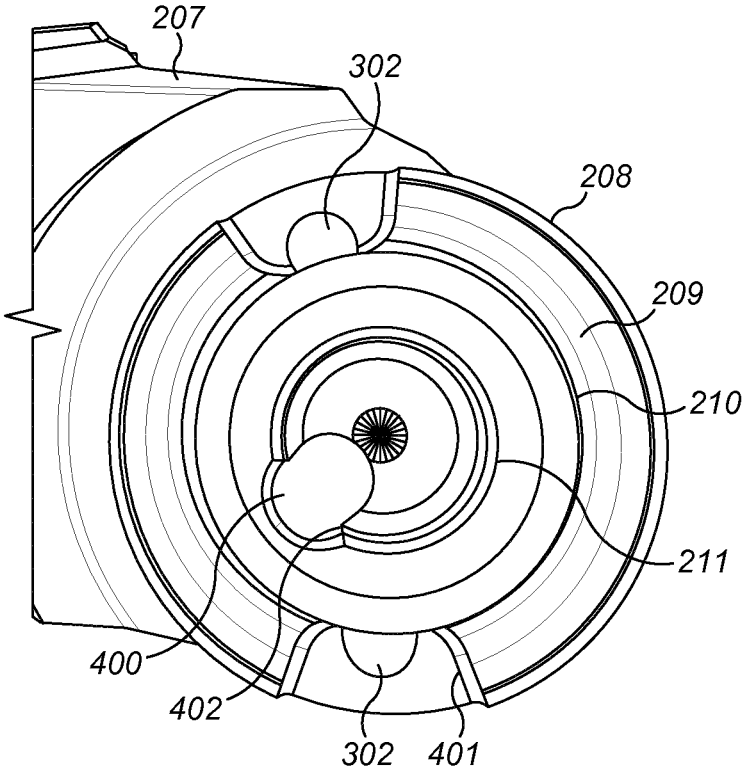
FIG. 4 is a plan view of the spindle of FIG. 2.
Figure 5:
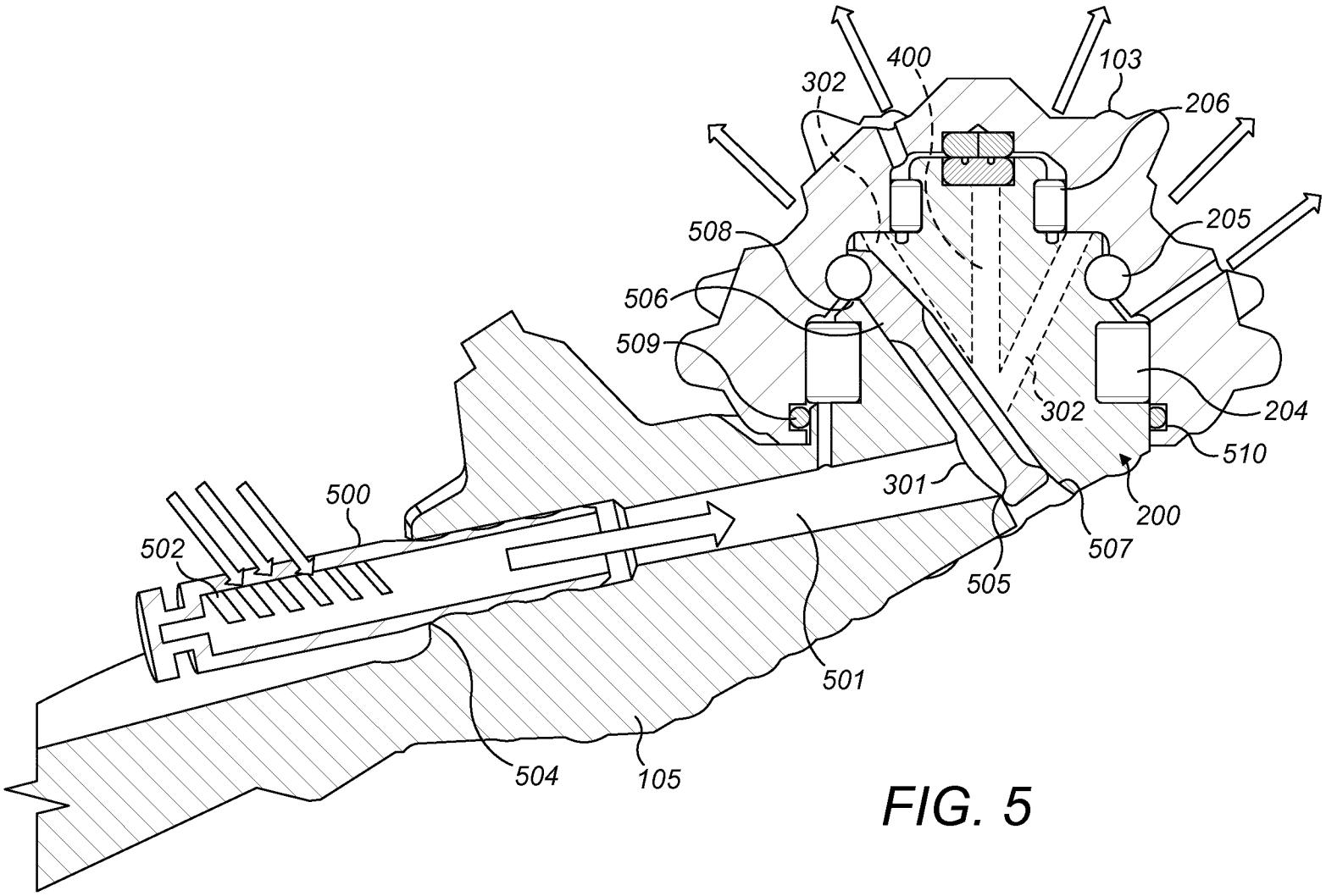
FIG. 5 is a cross sectional view through one of the cone cutters, spindle and journal legs of FIG. 1.
Figure 10:
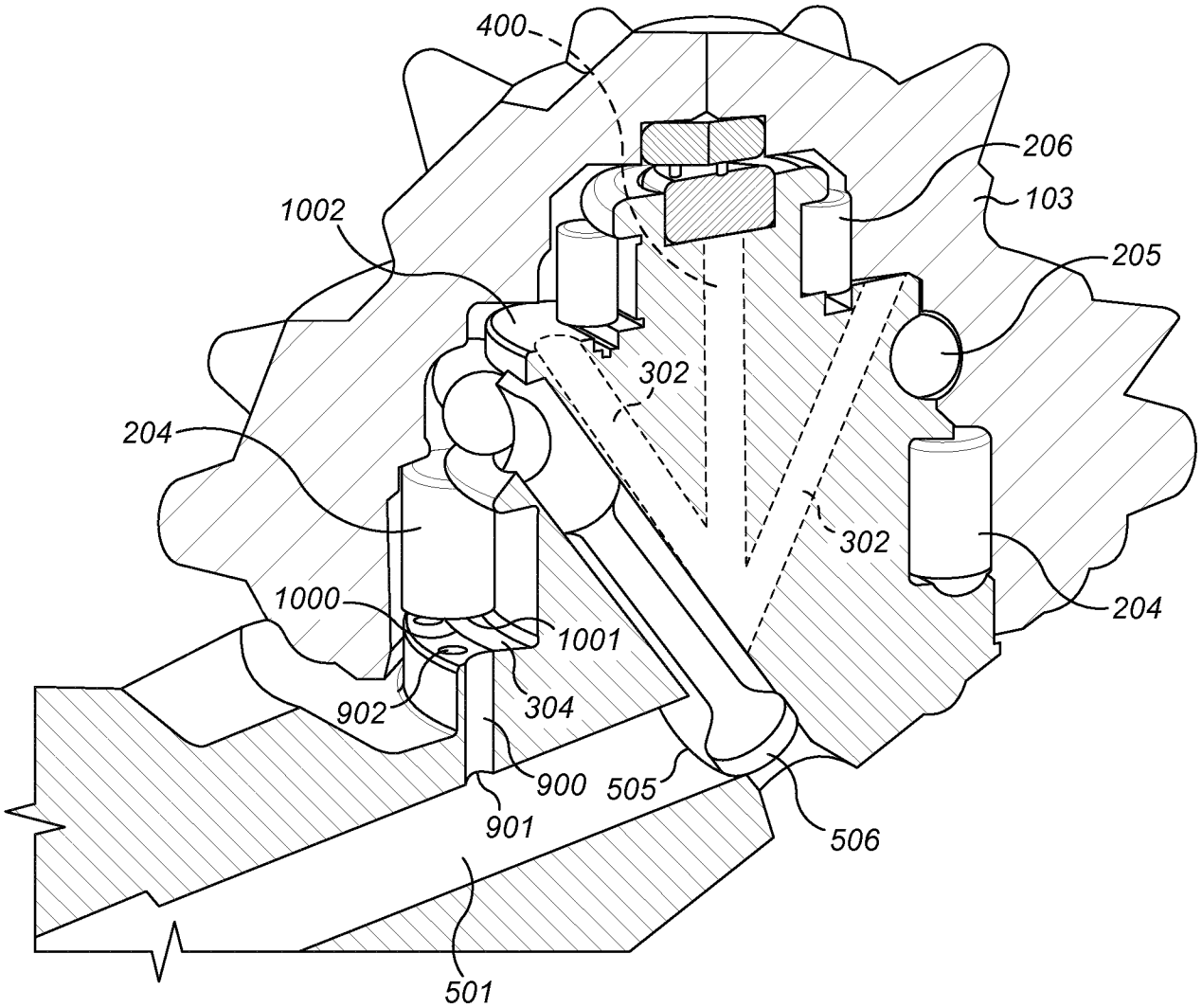
FIG. 10 is a further cross sectional perspective view of the cone cutter, spindle and journal leg of FIG. 1.
Figure 11:
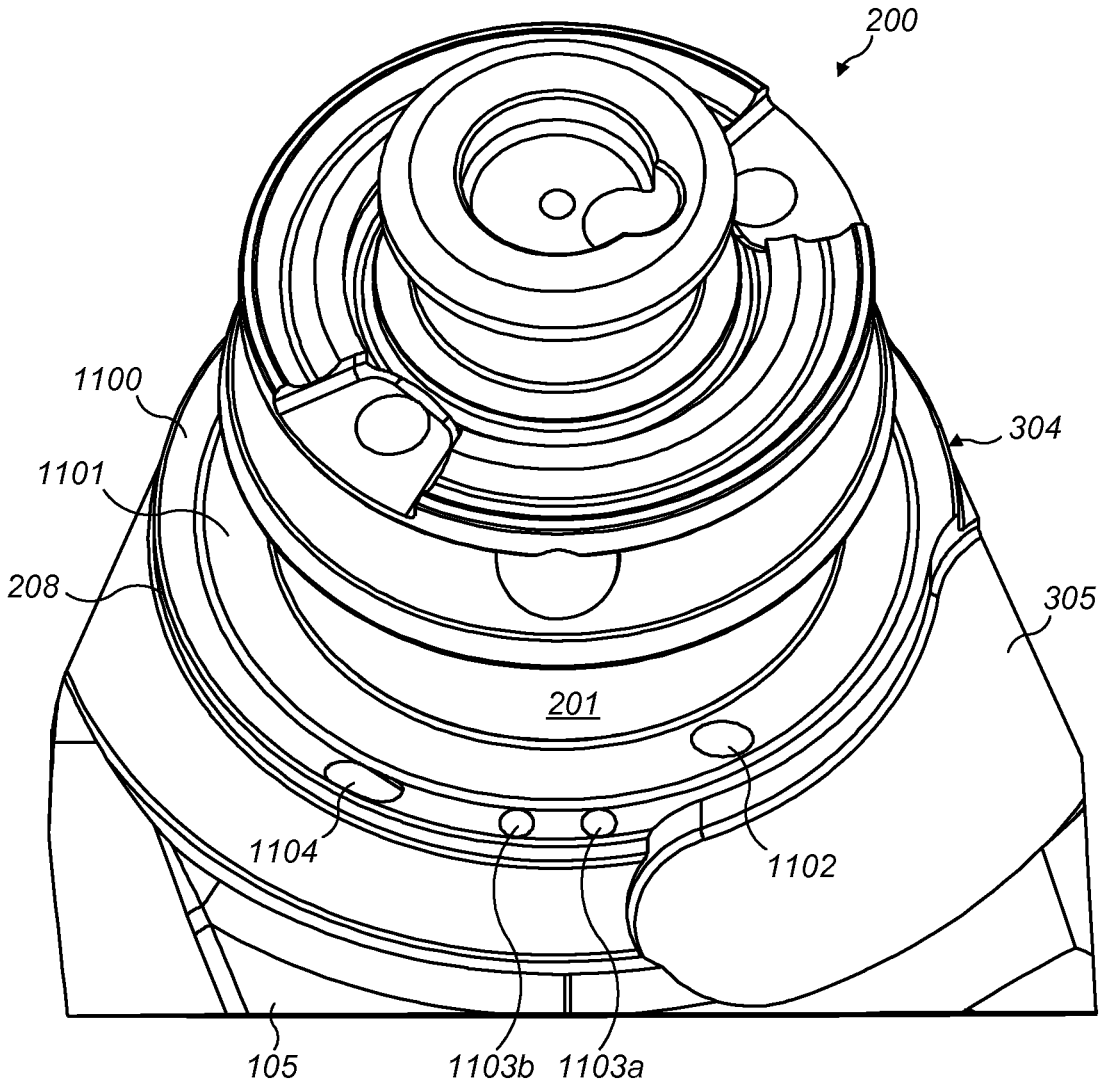
FIG. 11 is an external perspective view of the spindle and journal leg of FIG. 1 illustrating four by-pass passageways according to a specific implementation.
Figure 12:
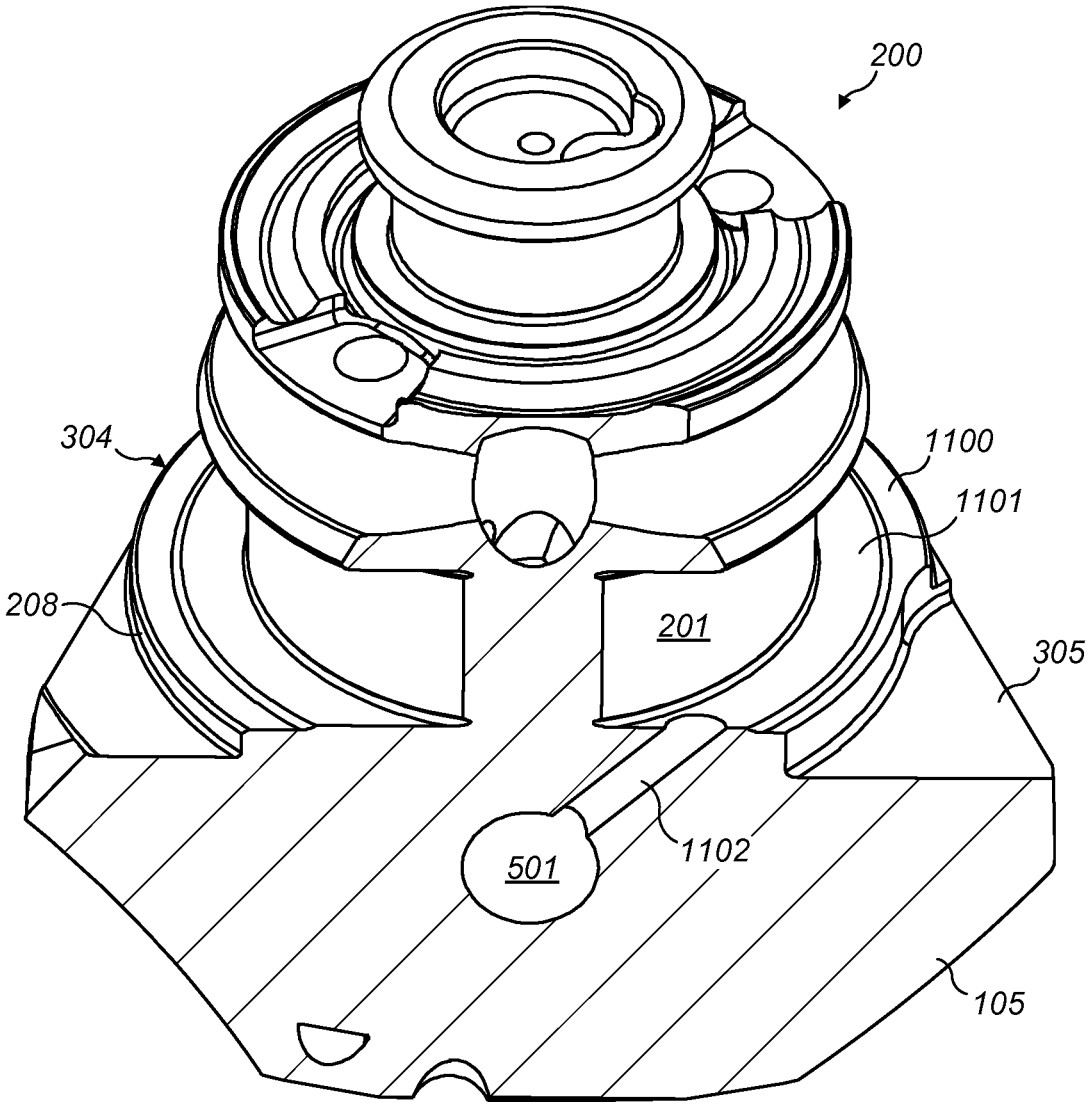
FIG. 12 is a cross sectional perspective view of the spindle and journal leg of FIG. 1 illustrating a first by-pass passageway according to a specific implementation.
Figure 13:
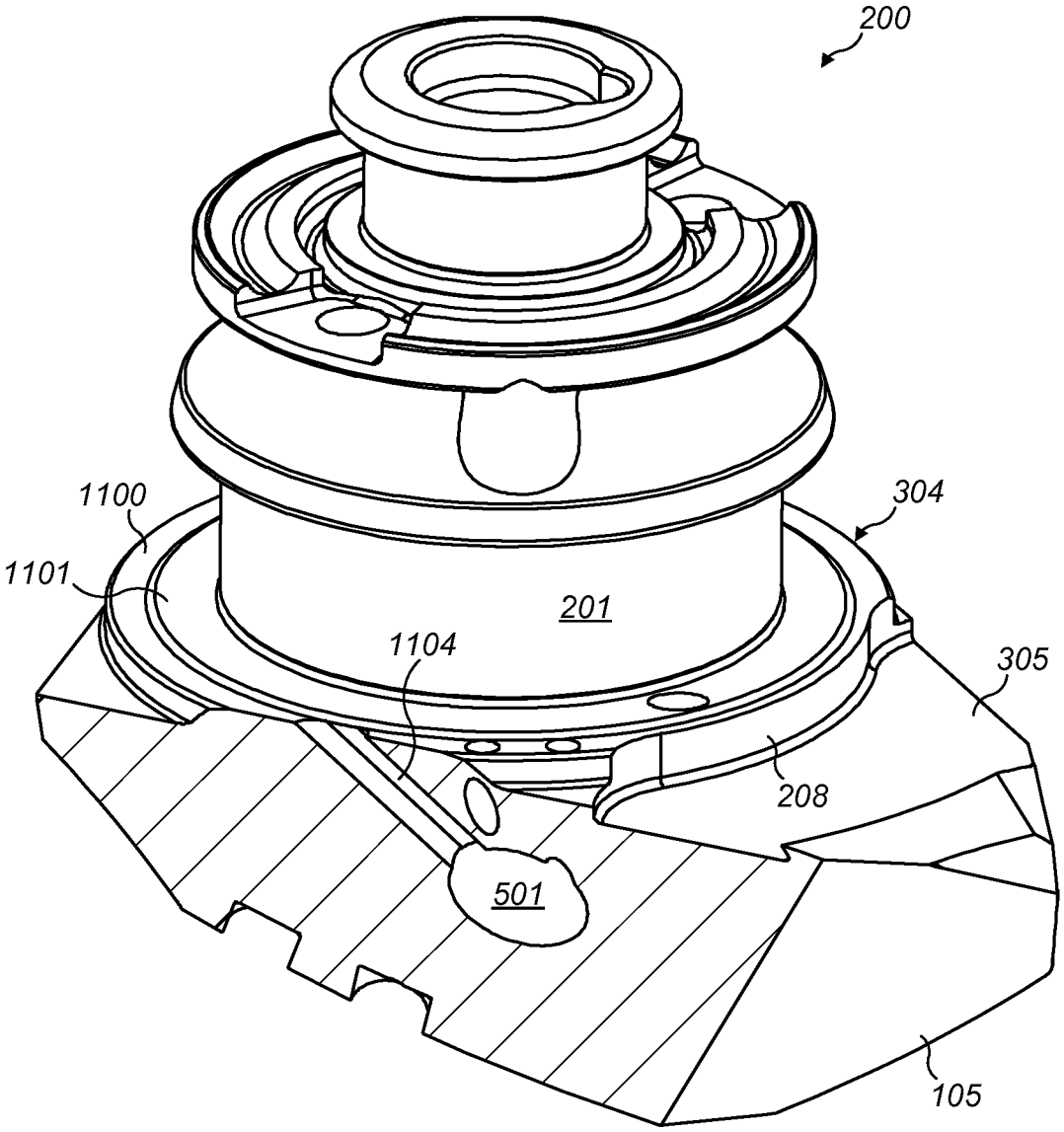
FIG. 13 is a further cross sectional perspective view of the spindle and journal leg of FIG. 1 illustrating a second by-pass passageway according to a specific implementation.
Figure 14:
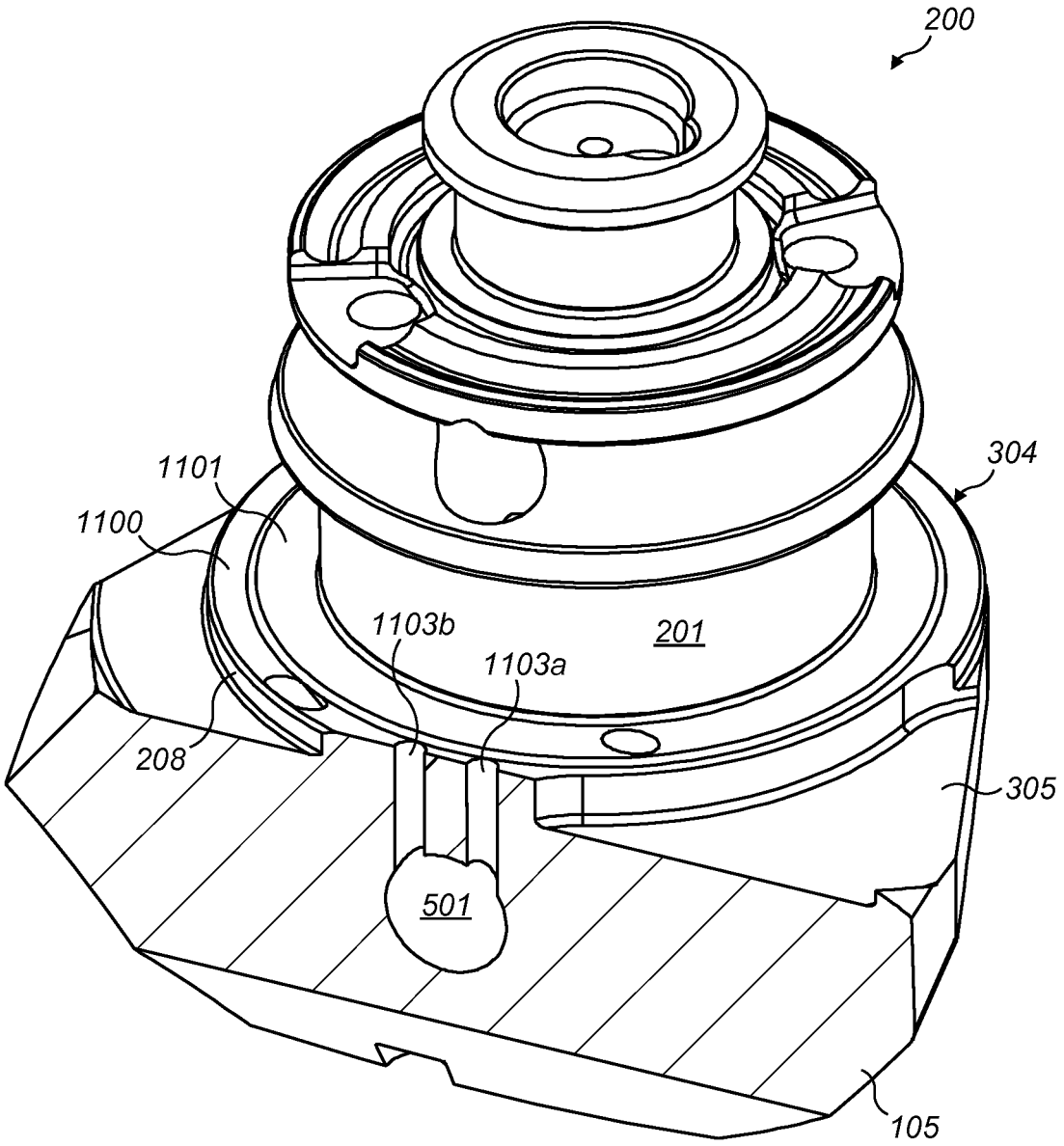
FIG. 14 is a further cross sectional perspective view of the spindle and journal leg of FIG. 1 illustrating a third and fourth by-pass passageway according to a specific implementation.

Referring to FIGS. 3A to 4, spindle 200 comprises a bearing support surface 304 facing axially forward at base flange 208 to support larger roller bearings 204 and a second axially forward facing surface (commonly referred to as a 'snoochie' face) provided at second intermediate flange 210. The annular snoochie face is formed by an annular groove 303 (at flange 210) that is filled with a carbide based wear resistant material so as to form a substantially planar annular thrust surface 1002 (illustrated in FIG. 10) to bear against and transmit the axial loading forces from cutter 103. The radially inner region of the snoochie face also provides support to mount the smaller roller bearings 206.

The axial load during cutting is also transmitted from cutter 103 to spindle 200 via i) the thrust plug 212*a* that bears against a cooperating thrust plug 212*b* mounted within an internal cavity of cutter 103 and ii) abutment contact between thrust surface 1002 and a corresponding surface 620 within the internal cavity of cutter 103. Bearings 204, 206 are configured to take the radial loads imparted by cutter 103 whilst bearings 205 lock cutter 103 in position about spindle 200 so as to be rotatably mounted at journal leg end 207.

Referring to FIGS. 3A to 5, spindle 200 and journal leg 105 comprise respective internal passageways configured to deliver air received from the drill rig and drill string (not shown) to the cutting region of tool 100. The air provides both cleaning of cuttings within the drill hole around the cutters 103 and also serves to cool the bearings 204, 205, 206 and the respective thrust surfaces. In particular, journal leg 105 comprises a supply passageway 501 extending generally in a direction from rearward end 102 to leg end 207. An air tube 500 is attached to a rearward end 504 of supply passageway 501 and comprises a plurality of air inlets 502 through which the air is channelled when received from the main body of tool 100. A terminal end 505 of supply passageway 501 is provided in fluid communication with a ball (or directing) passageway 301 being dimensioned to allow introduction of ball bearings 205 into position at raceway 202 when cutter 103 is mounted at spindle 200. Ball passageway 301 comprises a first end 507 being open at a rearward base region of spindle 200 and a second end 508 that emerges at ball bearing raceway 202. A ball plug 506 is releasably mounted within ball passageway 301 so as to retain bearings 205 in position at raceway 202. A weld or similar material (not shown) may be provided at passageway end 507 so as to secure plug 506 in position. A plurality of airflow distribution passageways extend from ball passageway 301 and are provided in fluid communication with supply passageway 501. In particular, two passageways 302 extend from ball passageway 301 to emerge at the snoochie face 1002 and a further distribution or pilot passageway 400 extends from ball passageway 301 to emerge at nose flange 211 adjacent thrust plug 212*a*. Each passageway 302 emerges at a recessed section 401 indented into annular grooved surface 303. Additionally, passageway 400 also emerges at a recessed section 402 of the pilot or thrust flange 211. Accordingly, air is configured to flow internally through each journal leg 105 and spindle 200 so as to be delivered to the friction bearing snoochie surface 1002 and the contact surfaces between thrust plugs 212*a*, 212*b* in addition to cooling the ball 205 and roller 204, 206 bearings.

The present tool 100 may be implemented as an open or semi-sealed tri-cutter assembly. According to the present semi-sealed implementation, the internal volume defined between the cone internal surface 616 and spindle 200 is at least partially sealed by a sealing gasket provided at a base region of spindle and cutter 103. In particular, an annular groove 510 is recessed into cutter internal cavity 600 and is dimensioned to accommodate a rubber O-ring 509 that partially projects radially into cavity 600 from annular groove 510. O-ring 509 is positioned to sit against an annular surface 306 provided at base flange 208 such that a seal is created between surface 306 and cone internal surface 616.

Figure 6:
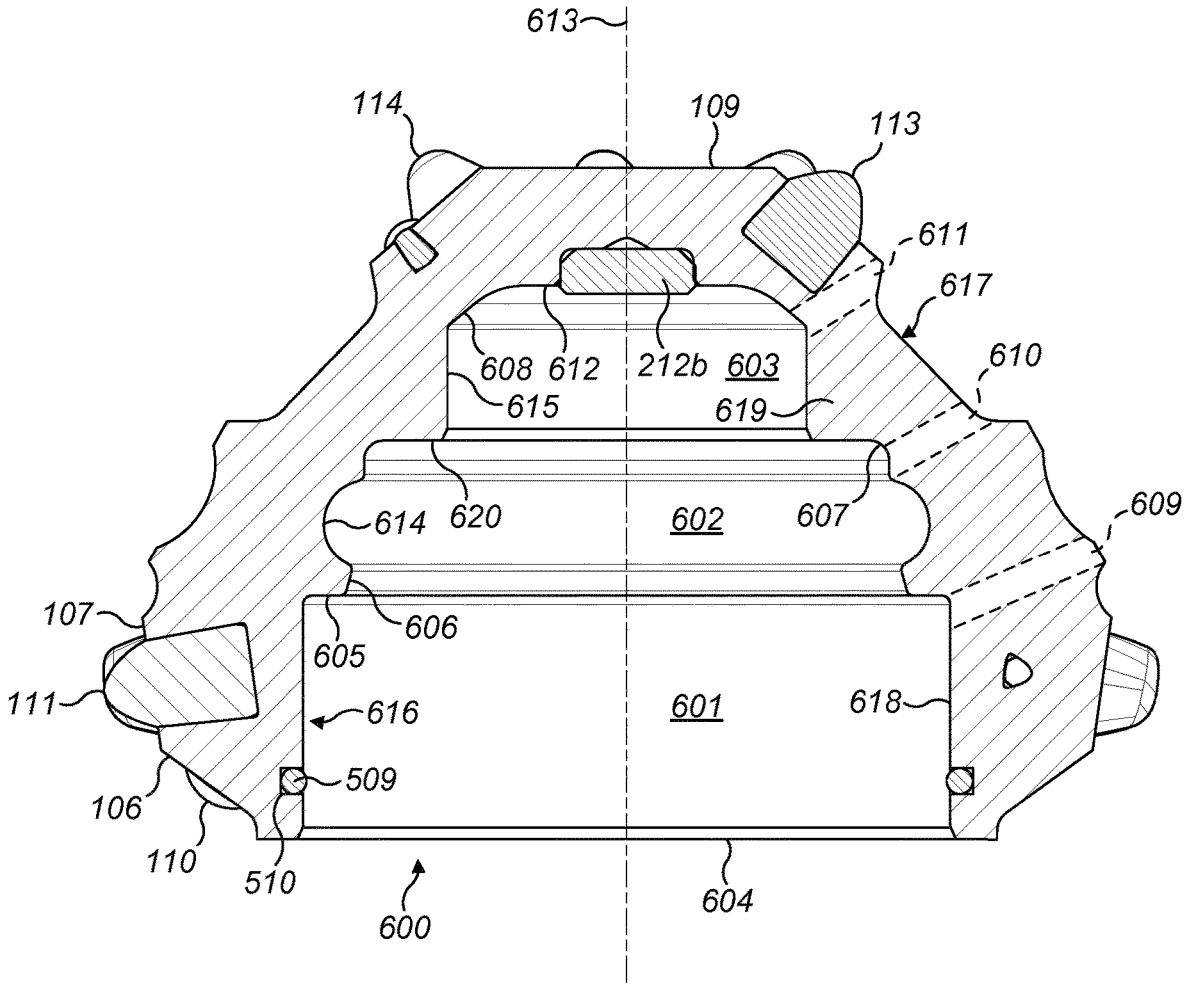
FIG. 6 is a cross section through one of the cone cutters of FIG. 1.
Figure 7:
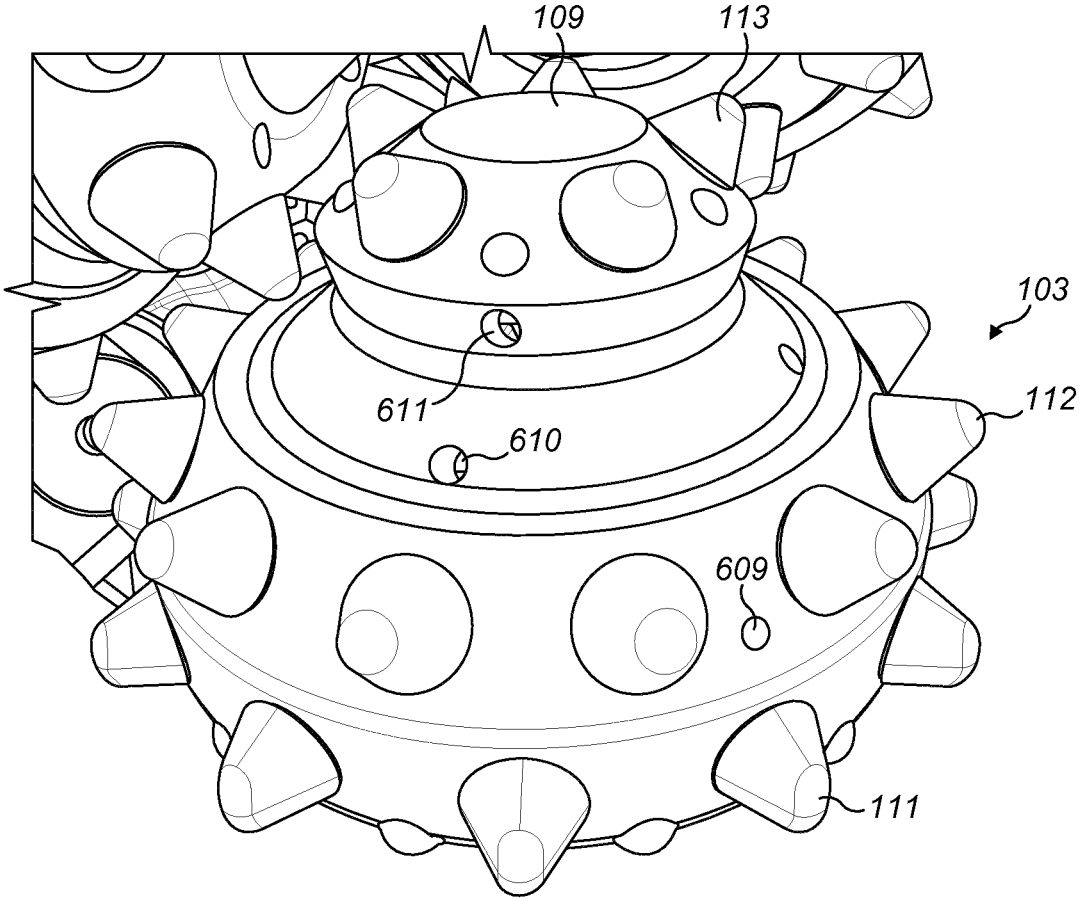
FIG. 7 is an external perspective view of one of the cone cutters of FIG. 1.
Figure 8:
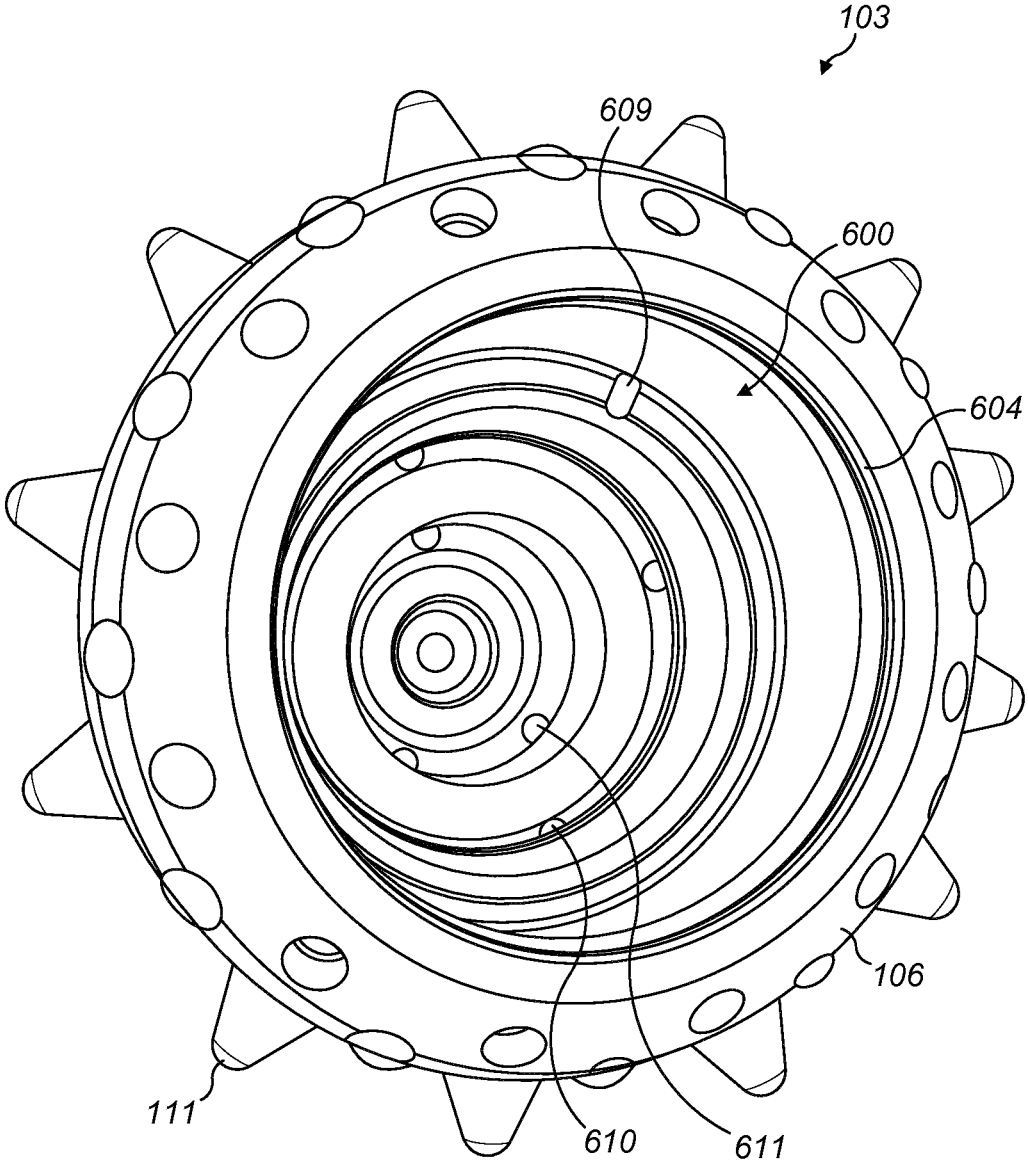
FIG. 8 is an underside perspective view of the cone cutter of FIG. 7 illustrating the cutter internal cavity.

Referring to FIGS. 6 to 8, the internal cavity 600 of cutter 103 may be divided into three axial sections relative to the cone longitudinal axis 613. A base section 601 extends inwardly from a cavity mouth 604 and is defined by an annular surface 618 aligned parallel to axis 613. Surface 618 is terminated by an annular end face 605 defined by a radially inward projecting annular first shoulder 606. An intermediate section 602 extends from base section 601 and is defined between first shoulder 606 and a radially inward projecting second annular shoulder 619. A corresponding curved annular region 607 is defined by second shoulder 619 and provides a terminal end of a concave surface 614 that defines intermediate section 602. Region 607 is terminated by the annular thrust bearing support surface 620 configured to be positioned in contact and to bear against snoochie surface 1002. An end or pilot section 603 extends from intermediate section 602 and is defined by annular surface 615 aligned substantially parallel to axis 613. Surface 615 is terminated by a concave or dome shaped surface 608 having an end or apex region 612 (that represents an end or innermost surface of cavity 600) that mounts the corresponding cutter thrust plug 212*b*.

Figure 9:
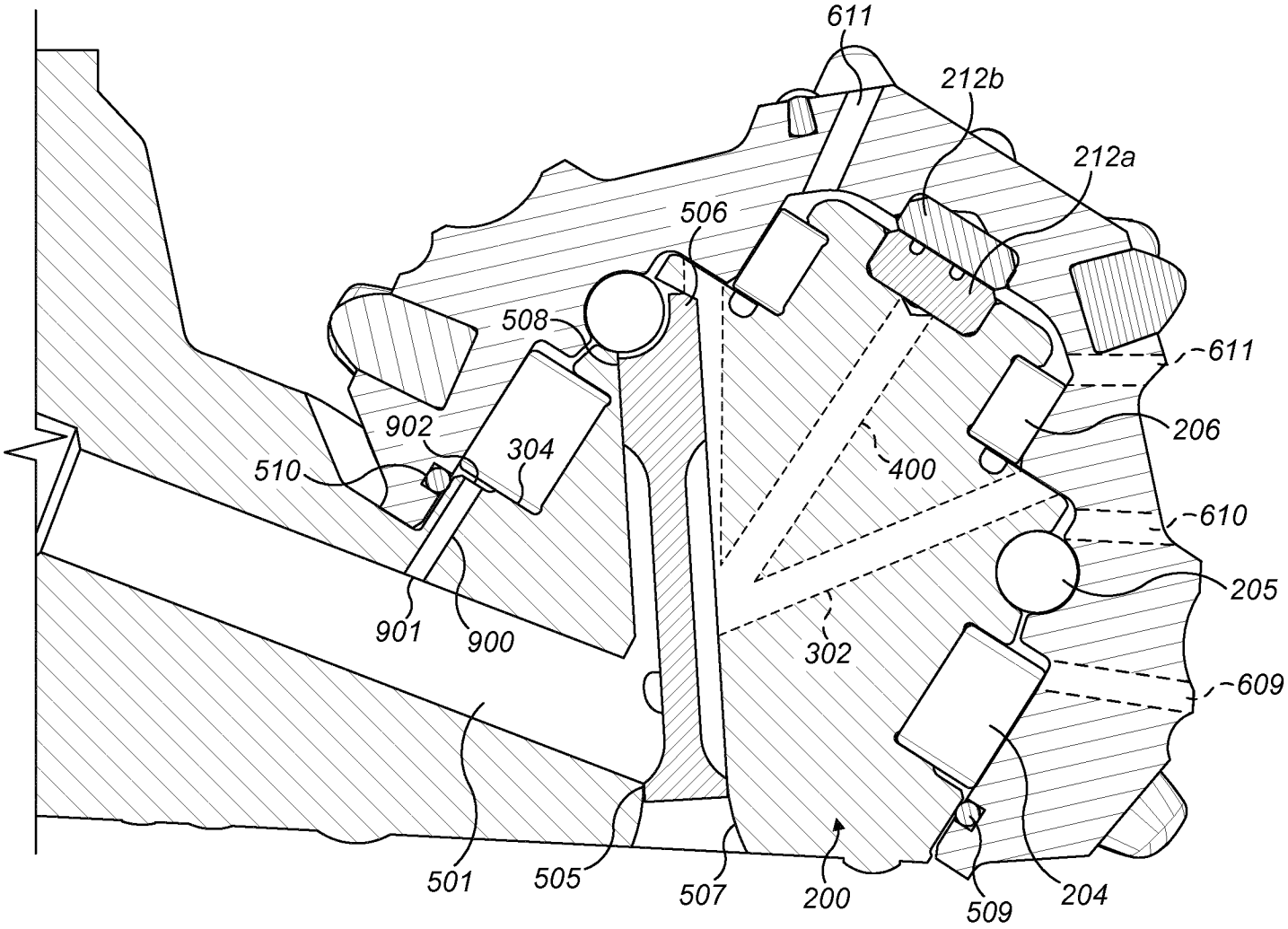
FIG. 9 is a further cross section through the cone cutter, spindle and journal leg of FIG. 1.

A plurality of vent holes are provided through the wall of cutter 103 and extend between the inward and outward facing surfaces 616, 617. In particular, one vent hole 609 extends radially outward from the region of first shoulder 606 substantially at a region of annular face 605 at base section 601. Four vent holes 610 project radially through the cutter wall being circumferentially spaced apart and extending generally from second shoulder 619 at surface 608 within intermediate section 602. Additionally, a third set of four vent holes 611 extend radially from cavity 600 at end section 603 corresponding to a position of domed end surface 608 at an axial end of annular surface 615. A combined cross sectional area of the nine vent holes 609, 610, 611 is approximately equal to or slightly less than a cross sectional area of supply passageway 501. Accordingly, this relative geometry and seal provided by O-ring 509 provides a positive pressure within cavity 600 when cutter 103 is mounted at spindle 200 and air is supplied through passageway 501, 301, 302 and 400, as disclosed in FIGS. 9 and 10.

Each journal leg 105 and spindle 200 also comprises a respective by-pass passageway 900 extending between supply passageway 501 and spindle base section 201. In particular, passageway 900 comprises a first end 901 in communication with supply passageway 501 and a second end 902 provided at bearing base surface 304. With cutter 103 mounted in position at spindle 200, by-pass passageway 900 is aligned substantially parallel to cutter axis 613 being transverse or perpendicular to supply passageway 501. Passageway end 902 emerges at a radially outer recessed section 1000 of bearing support surface 304 so as to be axially recessed from an end face 1001 of roller bearings 204. Additionally, the exit airflow end of by-pass passageway 900 is located inboard of seal 509 such that the air flow is directed inside of cutter cavity 600. By-pass passageway 900 may be divided into a plurality of by-pass passageways 900 exiting at different respective regions of the bearing support surface 304. Additionally according to further specific implementations, the tool 100 may comprise a plurality of by-pass passageways 900 extending generally from the same location of the supply passageway 501 and exiting at the bearing support surface 304 at different radial and circumferentially spaced apart locations.

Referring to FIGS. 11 to 14, support surface 304 is divided radially into an inner surface 1101 and an outer surface 1100. Inner surface 1101 is slightly axially raised relative to outer surface 1100 so as to provide a support for a part of the end face of the larger roller bearings 204. According to the specific implementation, by-pass passageway 900 comprises a plurality of passageways exiting support surface 304 at different locations with all the by-pass passageways extending from supply passageway 501.

In particular, a first by-pass passageway 1102 extends from supply passageway 501 to exit at the inner surface 1101. A second by-pass passageway 1104 extends from supply passageway 501 to exit at outer surface 1100 being circumferentially spaced from first by-pass passageway

1102. A second and third by-pass passageway 1103*a* and 1103*b* are aligned parallel to one another and positioned side-by-side to extend from supply passageway 501 to exit at outer surface 1100 and being circumferentially spaced apart from second passageway 1104. Accordingly, three by-pass passageways 1103*a*, 1103*b* and 1104 exit spindle 200 at outer surface 1100 and a single by-pass passageway 1102 exits spindle 300 at inner surface 1101. Such a configuration is effective to provide a direct supply of air to the undersigned region of the roller bearings 204 and to provide an appropriate airflow stream for optimised delivery and circulation at the entire bearing assembly. The present by-pass passageway configuration is also advantageous, in certain embodiments, to provide a desired exhaust air flow at the base flange 208 of the spindle 200 at the junction with the leg 105 The present configuration of by-pass passageways 900 (1102 to 1104) may be implemented with a semi-sealed or an 'open' cutter configuration with and without seal 509, respectively. Where the cutter comprises seal 509, the by-pass passageways 900 may be configured to provide a relatively small exhaust flow or air from the base flange 208 at channel 305. The present arrangement is advantageous in that when implemented in a semi-sealed embodiment, following use (and wear of the cutter 103, and potentially seal 509) a greater volume of air will be allowed to exhaust at the base of spindle 200 at the region of flange 208. However, the majority of the exhaust airflow stream will flow through vent holes 609, 610 and 611 when implemented according to the semi-sealed embodiment of FIGS. 1 to 14.

Figure 15:
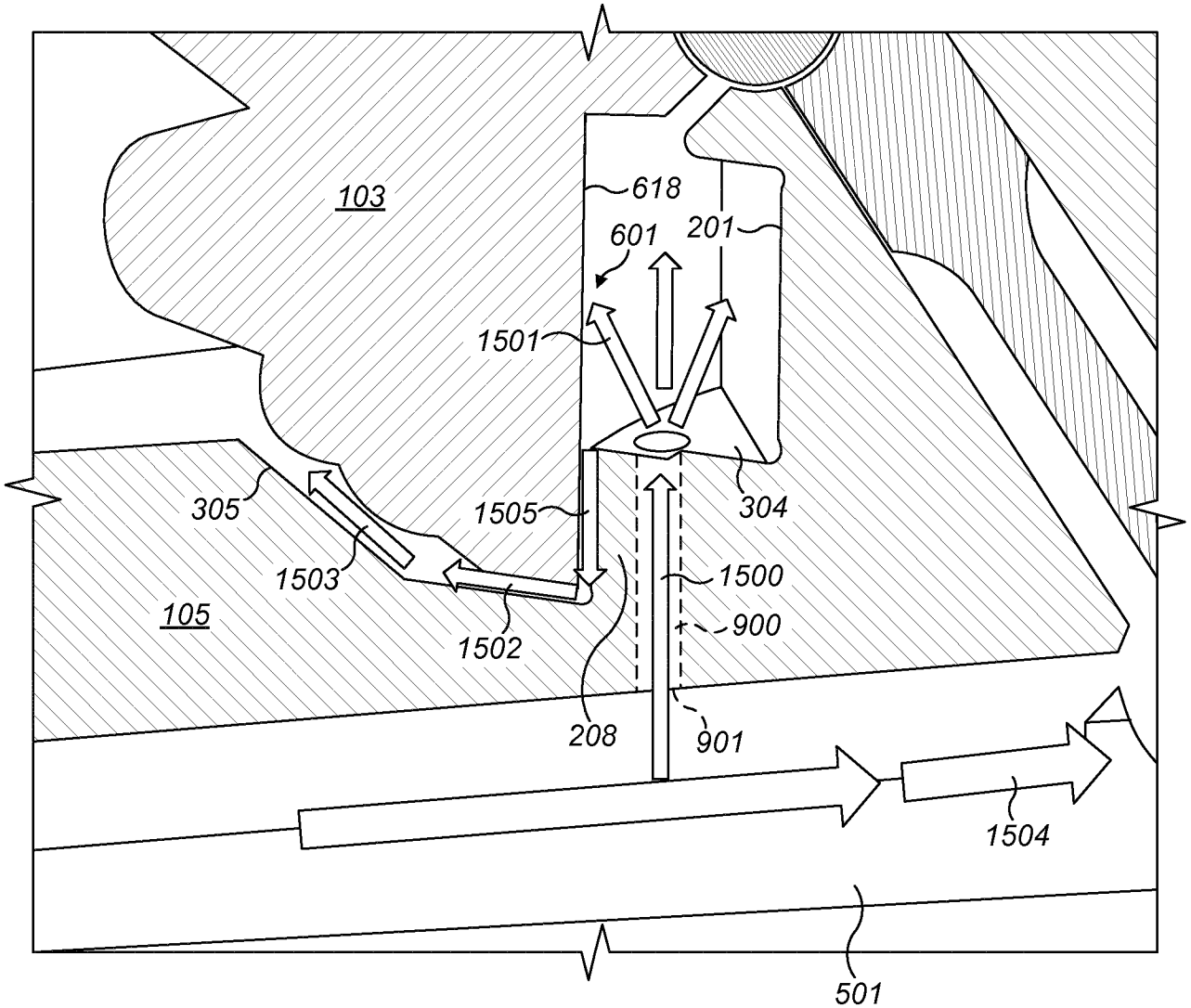
FIG. 15 is a magnified cross sectional view through the cone cutter, spindle and journal leg of FIG. 1 at a base region of the spindle and cutter.

FIG. 15 illustrates a further embodiment of the present by-pass passageway configuration implemented on an 'open' cutter arrangement without a base spindle seal 509. As with the semi-sealed arrangement by-pass passageway 900 is effective to divert a flow of air 1500 from the main airflow stream 1504 flowing through the passageway 501. The diverted airflow 1500 is supplied directly to the base region of the spindle at the larger roller bearings 204 as indicated schematically by arrows 1501 (roller bearings 204 are removed for illustrative purposes).

Specific to the 'open' cutter configuration, and where the cutter 103 does not comprise vent holes 609, 610 and 611, the airflow stream is directed to flow around the bearing assembly generally within cutter cavity 600 and to exit cavity 600 via stream 1505 flowing between the radially outward facing surface of spindle flange 208 and the radially inward facing surface 618 of cone cavity 600. The airflow 1502 then continues radially outward from flange 208 and within channel 305 to provide an exhaust airflow stream 1503 at channel 305. Such a configuration is effective to displace accumulated dirt and debris from around the cavity mouth 604 and to prevent ingress into the cavity 600 and in contact with bearings 204, 205 and 206 and spindle 200.

Airflow distribution passageways 302, 400 are beneficial to distribute the supply of air to the high load/friction snoochie surface region 1002 and the contact surfaces between the pilot thrust plugs 212*a*, 212*b*. Distribution passageways 302, 400 provide effective control of the distribution of airflow to all regions of the bearing assembly which in addition to by-pass passageway 900 serves to cool and clean the high friction contact surfaces between spindle 200, bearings 204, 205, 206 and parts of the cone internal surface 616 so that they do not overheat and wear prematurely.

Additionally, vent holes 609, 610, 611 are specifically positioned at the corner regions of the internal cavity 600 corresponding to the junctions between the three internal sections 601, 602, 603. The relative positioning and cross sectional area of vent holes 609, 610, 611 is effective to control the exhaust of the cleaning and cooling air supply from tool 100 so as to provide an optimised airflow path around the high load and friction components prior to exhaust. The respective location of the exit ends of vent holes 609, 610, 611 at the different axial sections of cone external surface 617 is effective to ensure cut rock and debris is constantly ejected from all parts of the external surface by the exhaust airflow.

The invention claimed is:

1. A rotary drill tool for cutting rock comprising:

a main body having a leg;

a spindle projecting from the leg to mount a rotary cutter via a plurality of bearings, the plurality of bearings including a first set of roller bearings, a second set of roller bearings and a set of ball bearings, wherein the spindle includes a longitudinal axis, a base region, a base raceway extending axially between the base region and a bearing raceway, the bearing raceway having a concave external surface and extending axially between the base region and an annular shoulder and an annular section extending axially between the bearing raceway and an end of the spindle, the annular shoulder being positioned axially between the bearing raceway and the end;

a fluid supply passageway extending through the leg and having a terminal end positioned in communication with a fluid directing passageway extending through the spindle, at least a part of the fluid directing passageway configured to allow at least some of the bearings to be loaded into position between the spindle and the cutter, wherein the cutter includes at least one vent hole positioned at or towards an apex of the cutter and a fluid received from the fluid directing passageway exiting the tool from the at least one vent hole;

a by-pass passageway extending through the base region of the spindle, the by-pass passageway emerging at the base raceway and having a first end in communication with a section of the fluid supply passageway upstream of the terminal end and a second end that emerges from the base region of the spindle to supply fluid to the first set of roller bearings, the base raceway being arranged to mount the first set of roller bearings at or towards the base region of the spindle, the set of ball bearings being positioned at the bearing raceway axially between the first set of roller bearings and the end of the spindle, an end of the fluid directing passageway emerging at the bearing raceway, the second end of the by-pass passageway emerging at the first set of roller bearings, wherein the second set of roller bearings are mounted at the annular section towards the end of the spindle and the set of ball bearings are mounted axially between the first and second set of roller bearings; and at least one distribution passageway extending within the spindle and provided in communication with the fluid directing passageway, wherein the distribution passageway is divided into at least two passageways, a first passageway exiting the spindle at the shoulder and a second passageway exiting the spindle at the end.

2. The tool as claimed in claim 1, wherein the by-pass passageway extends transverse or substantially perpendicular to the supply passageway.

3. The tool as claimed in claim 1, wherein the by-pass passageway is aligned substantially parallel with a longitudinal axis of the spindle.

4. The tool as claimed in claim 1, wherein the base raceway is defined, in part, by a bearing support surface aligned substantially perpendicular or transverse to the longitudinal axis of the spindle, the by-pass passageway emerging at the bearing support surface.

5. The tool as claimed in claim 4, wherein an end surface of each of the first set of roller bearings is positioned in contact with the bearing support surface, the by-pass passageway emerging adjacent to the end surfaces of the first set of roller bearings.

6. The tool as claimed in claim 1, further comprising an annular seal positioned between the base region of the spindle and the cutter to restrict fluid exiting the tool at the base region, the seal defining a semi-sealed internal region of the cutter in which the bearings are located.

7. The tool as claimed in claim 6, wherein the second end of the by-pass passageway emerges at the internal region.

8. The tool as claimed in claim 1, wherein a cross-sectional area of the by-pass passageway is substantially equal to or less than a cross-sectional area of each of the first and second distribution passageways.

9. The tool as claimed in claim 1, wherein the fluid by-pass passageway is a single by-pass passageway extending in communication between the section of the supply passageway and the bearings.

10. The tool as claimed in claim 1, wherein the fluid by-pass passageway is a plurality of by-pass passageways extending from at least one section of the supply passageway upstream of the terminal end.

11. The tool as claimed in claim 1, comprising three sets of vent holes, a first set of vent holes being positioned at or towards a base of the cutter, a third set of vent holes being positioned at or towards the apex of the cutter and a second set of vent holes being positioned axially between the first and third sets of vent holes, wherein the by-pass passageway emerges from the spindle at a position axially closer to the base region of the cutter relative to a position at which the first set of vent holes extend through the cutter.

* * * * *